US008194023B2

(12) United States Patent
Park

(10) Patent No.: US 8,194,023 B2
(45) Date of Patent: Jun. 5, 2012

(54) SWITCH UNIT IN A DRIVING CIRCUIT OF FLAT PANEL DISPLAY AND DRIVING METHOD THEREOF

(75) Inventor: Soo-Yang Park, Chungcheongbuk-do (KR)

(73) Assignee: MagnaChip Semiconductor Ltd., Chungcheongbuk-do (KR)

( * ) Notice: Subject to any disclaimer, the term of this patent is extended or adjusted under 35 U.S.C. 154(b) by 733 days.

(21) Appl. No.: 12/071,890

(22) Filed: Feb. 27, 2008

(65) Prior Publication Data

US 2008/0204386 A1 Aug. 28, 2008

(30) Foreign Application Priority Data

Feb. 28, 2007 (KR) ..... 10-2007-0020284

(51) Int. Cl.
*G09G 3/36* (2006.01)

(52) U.S. Cl. ..... 345/96; 345/89

(58) Field of Classification Search ..... 345/87, 345/89, 98, 94–96, 100, 204, 208, 210
See application file for complete search history.

(56) References Cited

U.S. PATENT DOCUMENTS

| | | | | |
|---|---|---|---|---|
| 5,623,279 | A * | 4/1997 | Itakura et al. | 345/98 |
| 5,973,660 | A * | 10/1999 | Hashimoto | 345/98 |
| 2005/0151714 | A1* | 7/2005 | Hirama | 345/100 |
| 2010/0033411 | A1* | 2/2010 | Lee | 345/87 |

FOREIGN PATENT DOCUMENTS

| | | |
|---|---|---|
| JP | 10-062744 | 3/1998 |
| JP | 2006-292899 | 12/2006 |
| KR | 1020020020416 A | 3/2002 |
| KR | 1020050112263 A | 11/2005 |

* cited by examiner

*Primary Examiner* — Chanh Nguyen
*Assistant Examiner* — Ram Mistry
(74) *Attorney, Agent, or Firm* — Morgan, Lewis & Bockius LLP

(57) ABSTRACT

A driving circuit of a flat panel display can transfer a signal input from a decoder to a corresponding channel while minimizing a size of a MOS transistor for a switch or an amplification driver. The driving circuit of the flat panel display includes a first data signal processing unit for converting a first display information that will be displayed on the flat panel display into a positive gamma value, a second data signal processing unit for converting a second display information that will be displayed on the flat panel display into a negative gamma value, an output driving unit for outputting the negative and positive gamma values to the flat panel display, and a switch unit for selectively transferring the positive and negative gamma values to the output driving unit.

7 Claims, 10 Drawing Sheets

PRIOR ART

SWITCH UNIT IN A DRIVING CIRCUIT OF FLAT PANEL DISPLAY AND DRIVING METHOD THEREOF

CROSS-REFERENCE TO RELATED APPLICATIONS

The present invention claims priority of Korean patent application number 10-2007-0020284, filed on Feb. 28, 2007, which is incorporated by reference in its entirety.

BACKGROUND OF THE INVENTION

The present invention relates to a driving circuit of a display, and more particularly to a driving circuit of a flat panel display and a driving method thereof.

In a recent information-oriented society, the importance of display devices used as visual information conveying media has been emphasized. However, cathode ray tubes (CRTs) that have been widely used have major disadvantages in regard to their large size and weight. A variety of flat panel panel displays, which can overcome the limitations of the CRTS, such as a liquid crystal display (LCD), a field emission display (FED), a plasma display panel (PDP), and an electroluminescence (EL), have been developed and put to practical use.

The LCD displays an image by controlling an electric field applied to a liquid crystal layer in response to video signals. As the LCDs are thin and flat panel display devices having low power consumption, the LCDs are used as displays for portable computers such as laptop computers, office automation devices, audio/video devices, indoor/outdoor advertising display devices, and the like. As the LCDs have a slim characteristic and a lower power consumption characteristic, the CRTs have been quickly replaced with the LCDs. Particularly, LCD panels that drive liquid crystal cells using thin film transistors provide clear image quality and have low power consumption. Recently, development of production technology and achievement of research make it possible to provide large-sized, high resolution LCD panels.

FIG. 1 is a circuit diagram of a typical driving circuit of a flat panel display.

Referring to FIG. 1, the typical driving circuit includes data processing units 11, 12, 13, and 14 for converting and decoding data signals, amplification driver units 21, 22, 23, and 24, a switch unit 30, and a charge sharing unit 40. Here, the converting is performed to convert a digital signal into an analog signal. The data processing units 11, 12, 13, and 14 are classified into data processing units PDAC for processing positive gamma values and data processing units NDAC for processing negative gamma values. The amplification driver units 21, 22, 23, and 24 amplify signals output from respective corresponding data processing units, improve driving capability of the signals, and transfer the signals to the switch unit 30. The switch unit 30 is provided to transfer the signals output from the amplification driver units 21, 22, 23, and 24 to nodes A or nodes B. The signal passing through the switch unit drives unit elements of the flat panel display that are assigned to a corresponding channel via one of nodes A and B from said pair of nodes.

When the signals passing through the switch unit are transferred to the channels via the nodes A, the flat panel display is driven in the form of PNPNPN. When the signals passing through the switch unit are transferred to the channels via the nodes B, the flat panel display is driven in the form of NPNPNP.

The charge sharing unit 40 is provided for sharing electric charges of all the nodes A or all the nodes B after the signals passing through the switch drive the unit elements of the flat panel display.

A display using liquid crystal is driven with positive and negative values alternately to increase the service life of the liquid crystal. When each of the channels has both of a circuit driven with the positive value and a circuit driven with the negative value, a circuit area of the driving circuit and a power consumption increase. Accordingly, as shown in FIG. 1, the circuits driven with the positive value and the circuits driven with the negative value are alternately arranged and driven for the respective channels through a switch unit 30.

Meanwhile, a user recognizes an image nonlinearly rather than linearly. Therefore, there is a need for the conversion of linear display information into nonlinear display information. A gamma correction method has been widely used for the conversion. The data processing units PDAC and NDAC of FIG. 1 output gamma values that are obtained by gamma-correcting input data of display information. At this point, the data processing units PDAC outputs positive gamma values and the data processing units NDAC outputs negative gamma values.

The above-described driving circuit of the flat panel display is designed to amplify the signals that are decoded in the data processing units, improve the driving capability of the signals, and transfer the signals to the corresponding channels via the switch unit. The channel is one column of the flat panel display. The switch unit is generally formed of a metal oxide semiconductor (MOS) transistor. In this case, the signal is attenuated due to a turn-on resistance of the MOS transistor in the course of passing through the switch unit. In order to solve this problem, the driving capability of the signals output from the amplification driver units must be sufficiently improved or the turn-on resistance must be reduced. To realize this, a size of the MOS transistor for the amplification driver unit or the switch unit must be increased. This causes increase of the circuit area of the flat panel display.

SUMMARY OF THE INVENTION

Embodiments of the present invention provide a driving circuit of a flat panel display that can transfer a signal input from a decoder to a corresponding channel while minimizing a size of a MOS transistor for a switch or an amplification driver, and a driving method thereof.

In accordance with an aspect of the present invention, there is provided a driving circuit of a flat panel display which includes a first data signal processing unit for converting a first display information that will be displayed on the flat panel display into a positive gamma value, a second data signal processing unit for converting a second display information that will be displayed on the flat panel display into a negative gamma value, an output driving unit for outputting the negative and positive gamma values to the flat panel display, and a switch unit for selectively transferring the positive and negative gamma values to the output driving unit.

In accordance with another aspect of the present invention, there is provided a method for driving a flat panel display which includes converting a first display information to be displayed on the flat panel display into a positive gamma value, converting a second display information to be displayed on the flat panel display into a negative gamma value, transferring one of the positive and negative gamma values through switching operation, and driving the transferred gamma value to a corresponding channel of the flat panel display.

DESCRIPTION OF SPECIFIC EMBODIMENTS

Hereinafter, a driving circuit of a flat panel display in accordance with the present invention will be described in detail with reference to the accompanying drawings.

Figure 1:
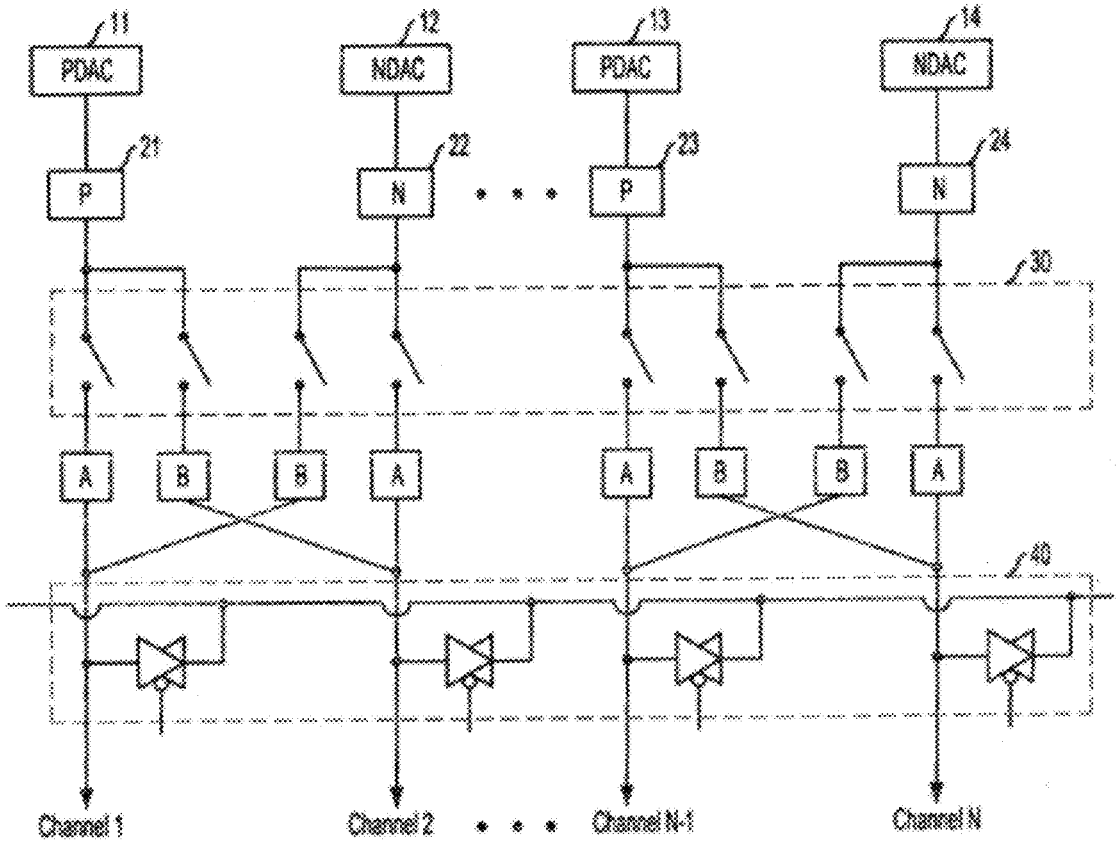
FIG. 1 is a circuit diagram of a typical driving circuit of a flat panel display.
Figure 2:
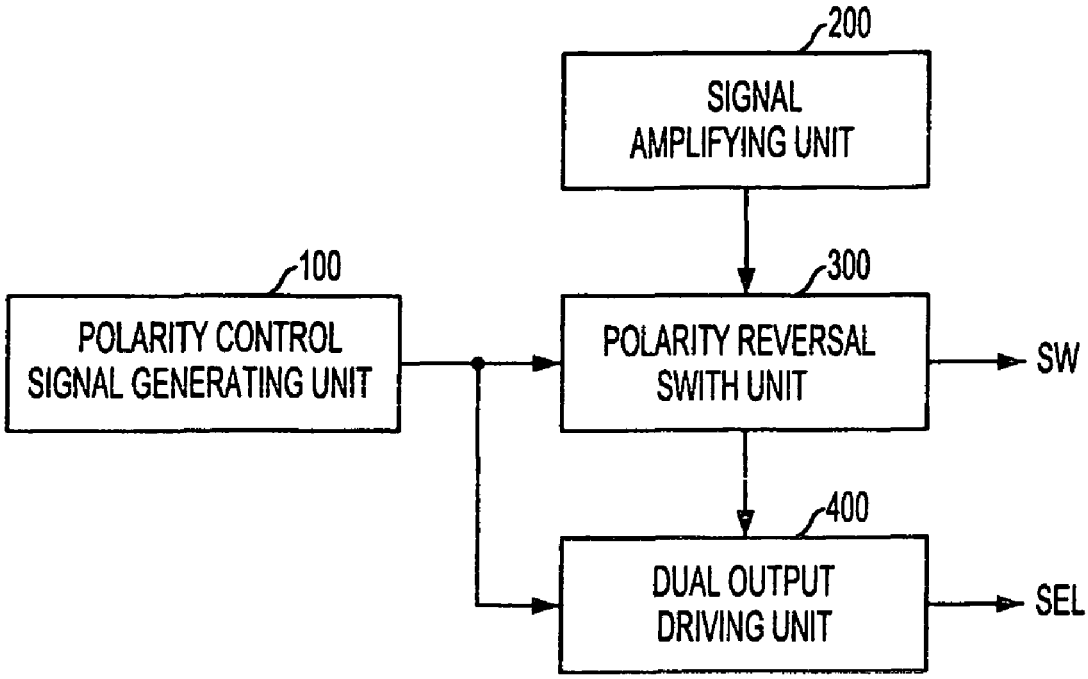
FIG. 2 is a block diagram of a driving circuit of a flat panel display in accordance with an embodiment of the present invention.

FIG. 2 is a block diagram of a driving circuit of a flat panel display in accordance with an embodiment of the present invention.

Referring to FIG. 2, the display driving circuit includes a polarity control signal generating unit 100, a signal amplifying unit 200, a polarity reversal switch unit 300, and a dual output driving unit 400. The polarity control signal generating unit 100 generates a variety of control signals required for operating the signal amplifying unit 200, the polarity reversal switch unit 300, and the dual output driving unit 400. The signal amplifying unit 200 amplifies a signal corresponding to display information displayed on the flat panel display. The polarity reversal switch unit 300 selects and transfers one of positive and negative gamma values output from the signal amplifying unit 200. The dual output driving unit 400 drives a channel using a corresponding positive gamma value output from the polarity reversal switch unit 300.

Figure 3:
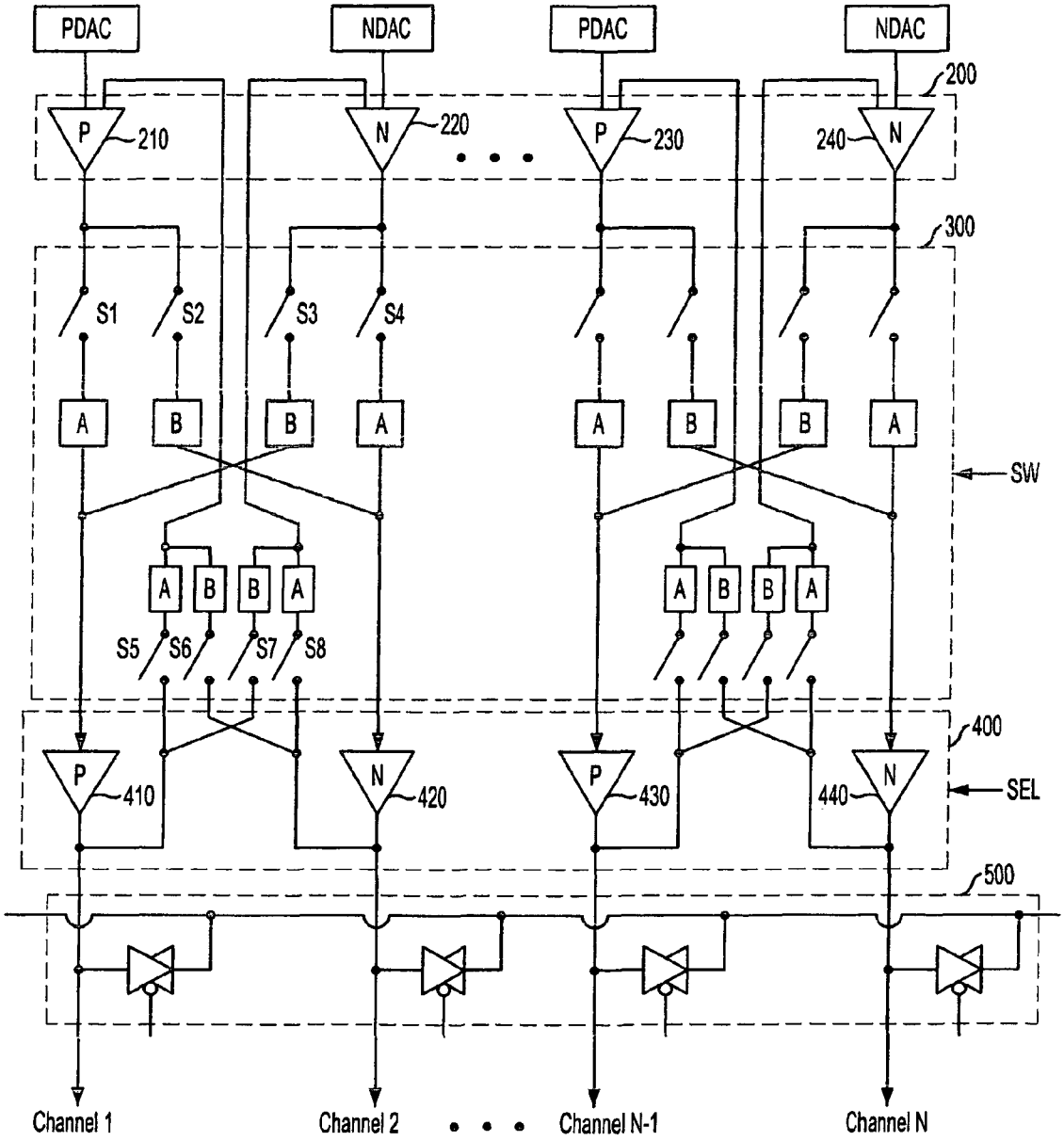
FIG. 3 is a schematic circuit diagram of the driving circuit of FIG. 2.

FIG. 3 is a schematic circuit diagram of the driving circuit of the flat panel display of FIG. 2.

Referring to FIG. 3, the display driving circuit includes first data process units PDAC for processing the positive gamma values, second data process units NDAC for processing negative gamma values, and a charge sharing unit 500. Here, the first and second data process units PDAC and NDAC and the signal amplifying unit 200 function as a data signal processor.

The signal amplifying unit 200 includes a plurality of first signal amplifiers 210 and 230 for receiving the positive gamma values from the first data process units PDAC to amplify the received positive gamma values, and a plurality of second signal amplifiers 220 and 240 for receiving the negative gamma values from the second data process units PDAC to amplify the received negative gamma values. The first signal amplifiers 210 and 230 and the second signal amplifiers 220 and 240 are alternately arranged.

The dual output driving unit 400 includes a plurality of output drivers 410, 420, 430, and 440. The switch unit 300 includes a plurality of sets of switches. Each set of the switches includes a first switch S1 for transferring an output of the first signal amplifier 210 to the output driver 410, a second switch S2 for transferring the output of the first signal amplifying unit 210 to the output driver 420, a third switch S3 for transferring an output of the second signal amplifier 220 to the output driver 410, a fourth switch S4 for transferring the output of the second signal amplifier 220 to the output driver 420, a fifth switch S5 for feedback of an output of the output driver 410 as an input of the first signal amplifier 210, a sixth switch S6 for feedback of the output of the output driver 410 as an input of the second signal amplifier 220, a seventh switch S7 for feedback of the output of the output driver 420 as the input of the first signal amplifier 210, and an eighth switch S8 for feedback of the output of the output driver 420 as the input of the second signal amplifier 220. As described above, the first to eighth switches S1 to S8 of each set are connected to two signal amplifiers and two output drivers.

Figure 4A:
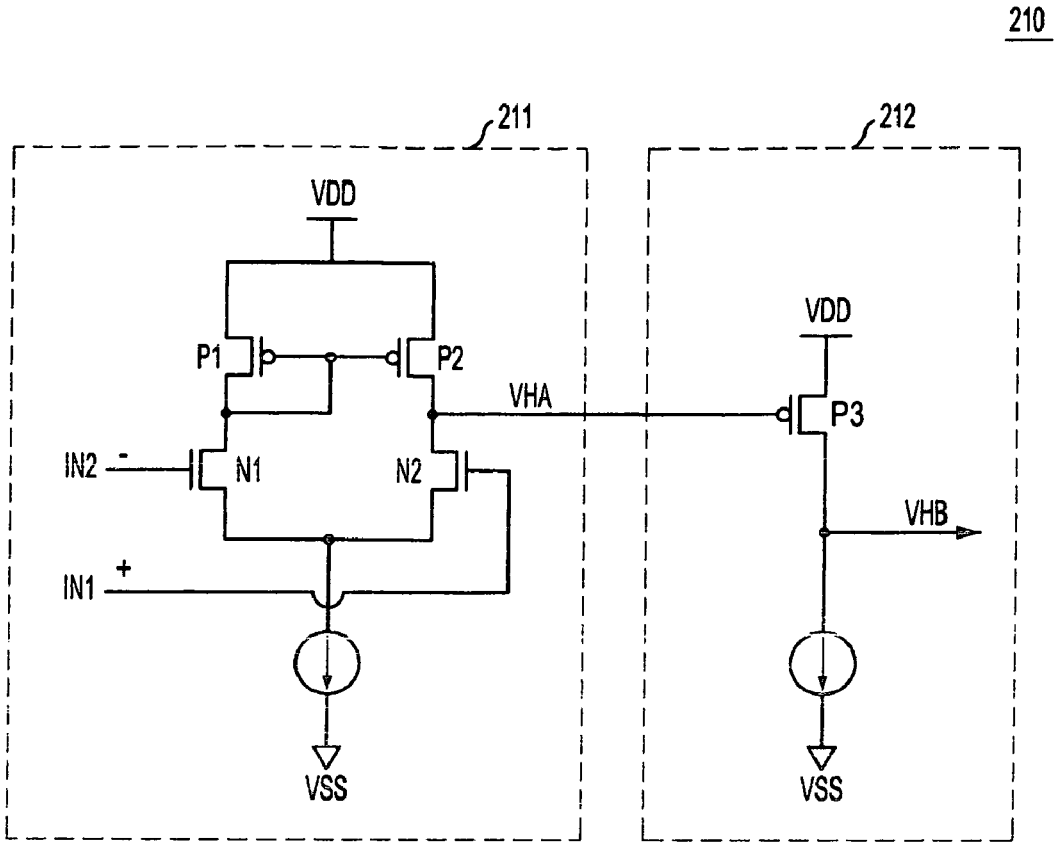
FIGS. 4A and 4B are circuit diagrams of a signal amplification unit depicted in FIG. 3.
Figure 4B:
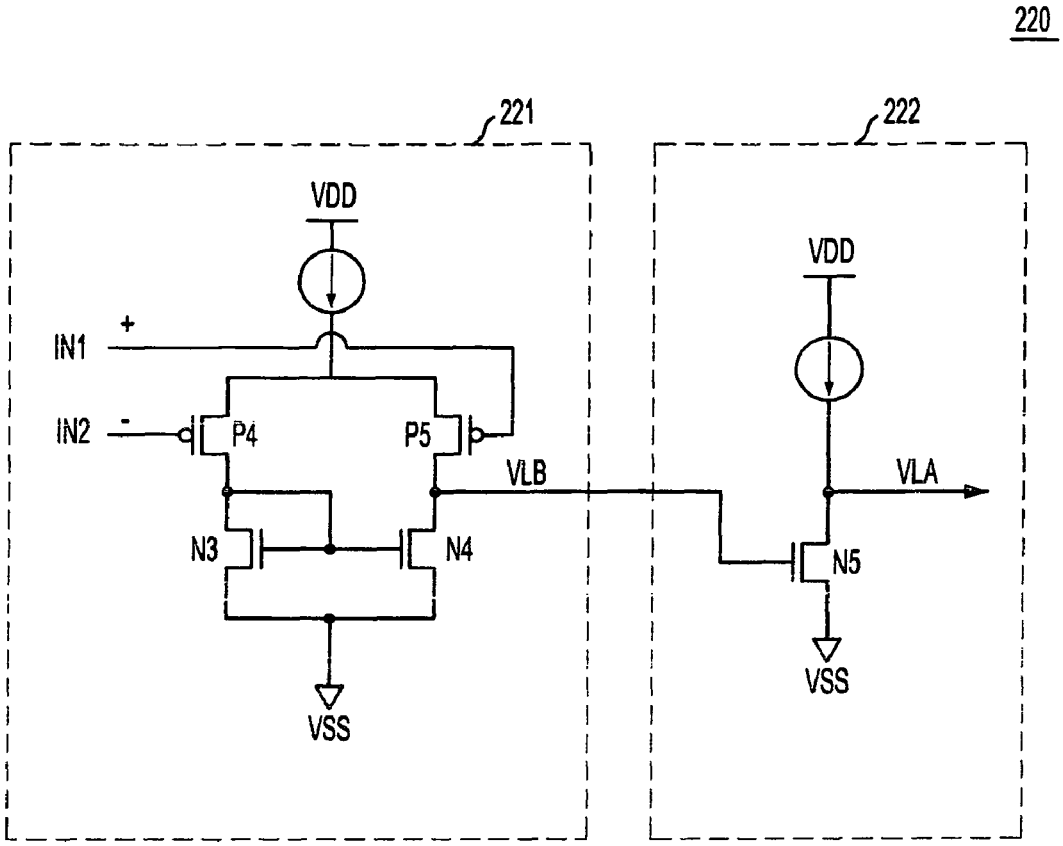

FIGS. 4A and 4B are circuit diagrams of the signal amplification unit depicted in FIG. 3.

As shown in FIGS. 4A and 4B, each of the signal amplifiers of the signal amplifying unit may includes a differential amplifier that uses a PMOS transistor as a rod or a differential amplifier that uses an NMOS transistor as a rod. In more detail, the first signal amplifier 210 includes a differential amplifier 211 and a signal output unit 212. The differential amplifier 211 outputs a first positive gamma value VHA that can charge electric charges in a corresponding channel by receiving an input signal IN1 corresponding to display information and an output of the output driver corresponding to the input signal IN1, i.e., an input signal IN2. The signal output unit 212 outputs a second positive gamma value VHB that can discharge the electric charges to a channel corresponding to display information in response to the output of the differential amplifier 211. The second signal amplifier 220 includes a differential amplifier 221 and a signal output unit 222. The differential amplifier 221 outputs a first negative gamma value VLA that can charge the electric charges in a corresponding channel by receiving an input signal IN1 corresponding to display information and an output of the output driver corresponding to the input signal IN1, i.e., an input signal IN2. The signal output unit 222 outputs a second negative gamma value VLB that can discharge the electric charges to a channel corresponding to display information in response to an output of the differential amplifier 221.

Figure 5:
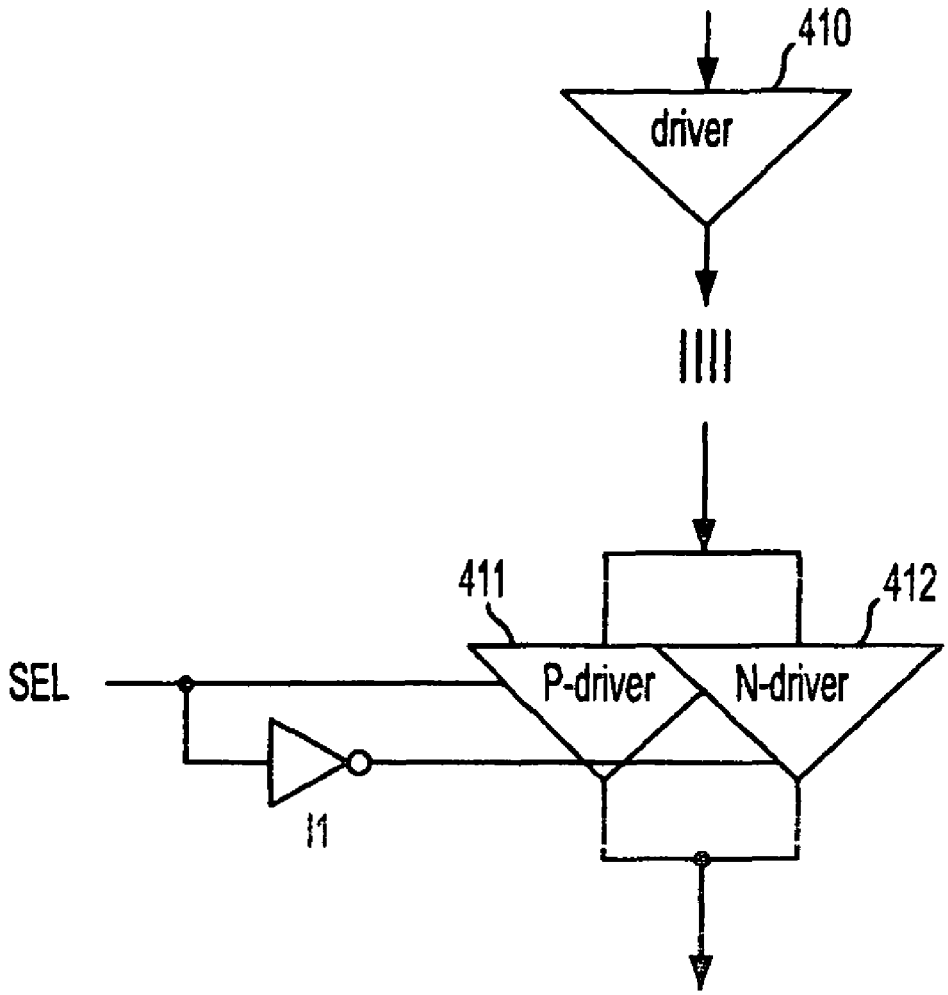
FIG. 5 is a circuit diagram of a dual output driving unit depicted in FIG. 3.

FIG. 5 is a circuit diagram of the dual output driving unit depicted in FIG. 3.

As shown in FIG. 5, the output driver 410 of the dual output driving unit includes a positive signal driver P-DRIVER that improves driving capability of a signal transferred via the switch unit 300 when the signal is the positive gamma value and a negative signal driver N-DRIVER that improves driving capability of a signal transferred via the switch unit 300 when the signal is the negative gamma value.

Figure 6:
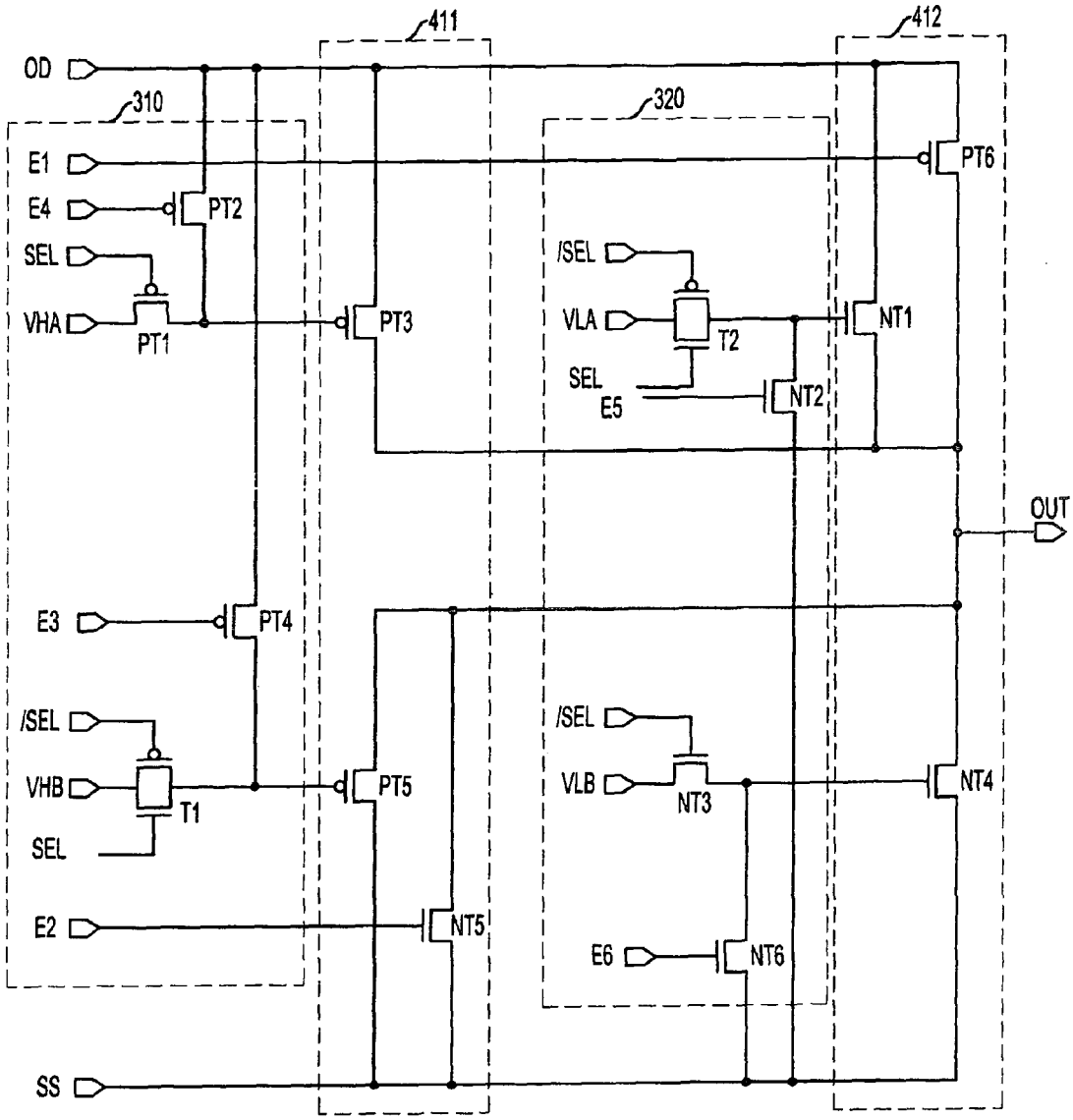
FIG. 6 is a circuit diagram of a polarity reversal switch unit and an output driving unit depicted in FIG. 2.

FIG. 6 is a circuit diagram of the polarity reversal switch unit and the output driving unit that are depicted in FIG. 2.

FIG. 6 is a diagram of a practical circuit of the switching unit and the output driving unit.

Circuits 310 and 320 function as the switch unit 300 of FIG. 3, and circuits 411 and 412 function as the P-DRIVER and the N-DRIVER that are depicted in FIG. 5. Selection signals SEL and /SEL are control signals generated by the polarity control signal generating unit 100. Driving signals VHA, VHB, VLA, and VLB are transferred to the channels through one output terminal. The switches 310 and 320 are enabled in response to enable signals El, E2, E3, E4, E5, and E6.

Figure 7A:
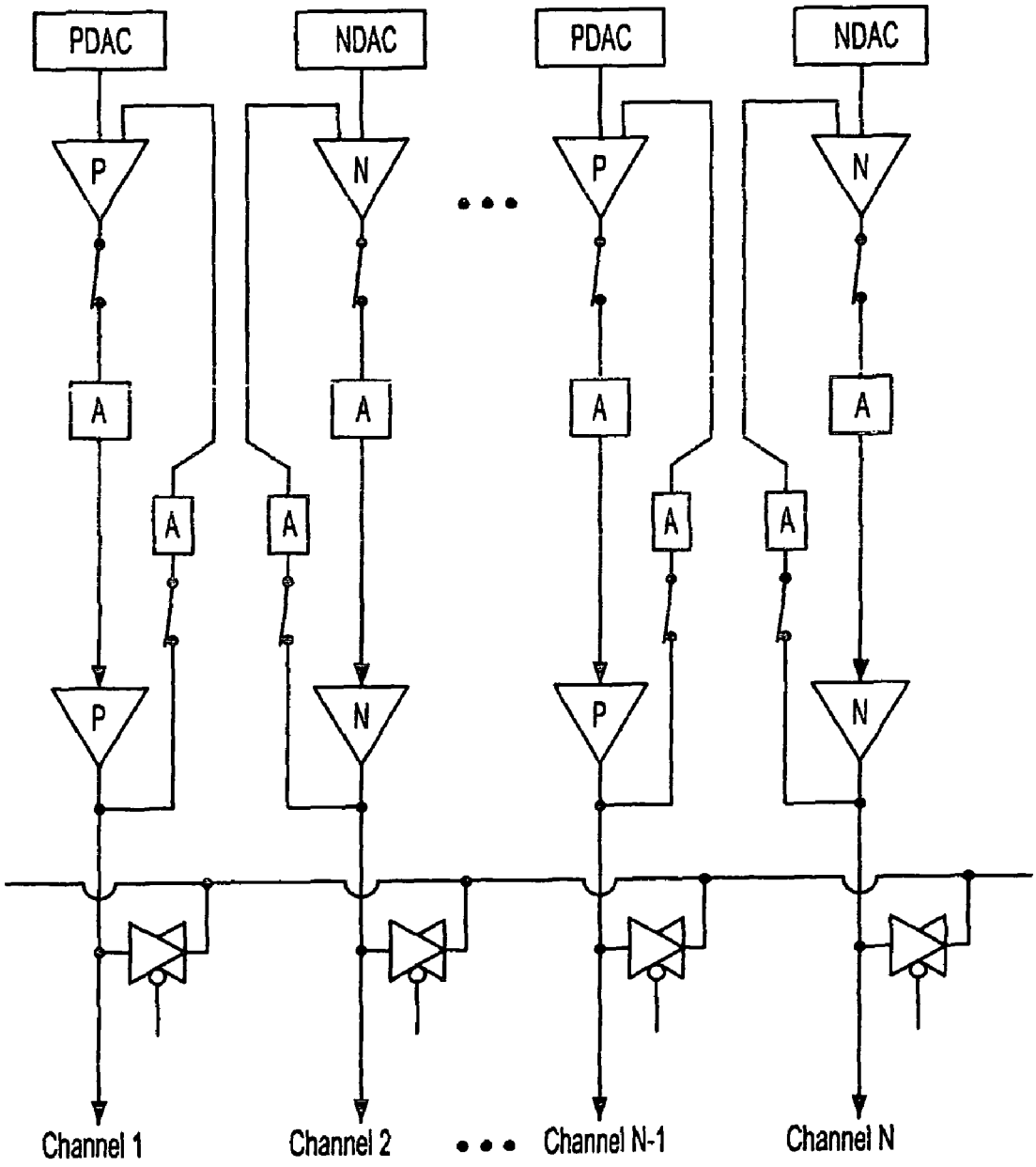
FIGS. 7A and 7B are circuit diagrams illustrating operation of the driving circuit of FIG. 3.
Figure 7B:
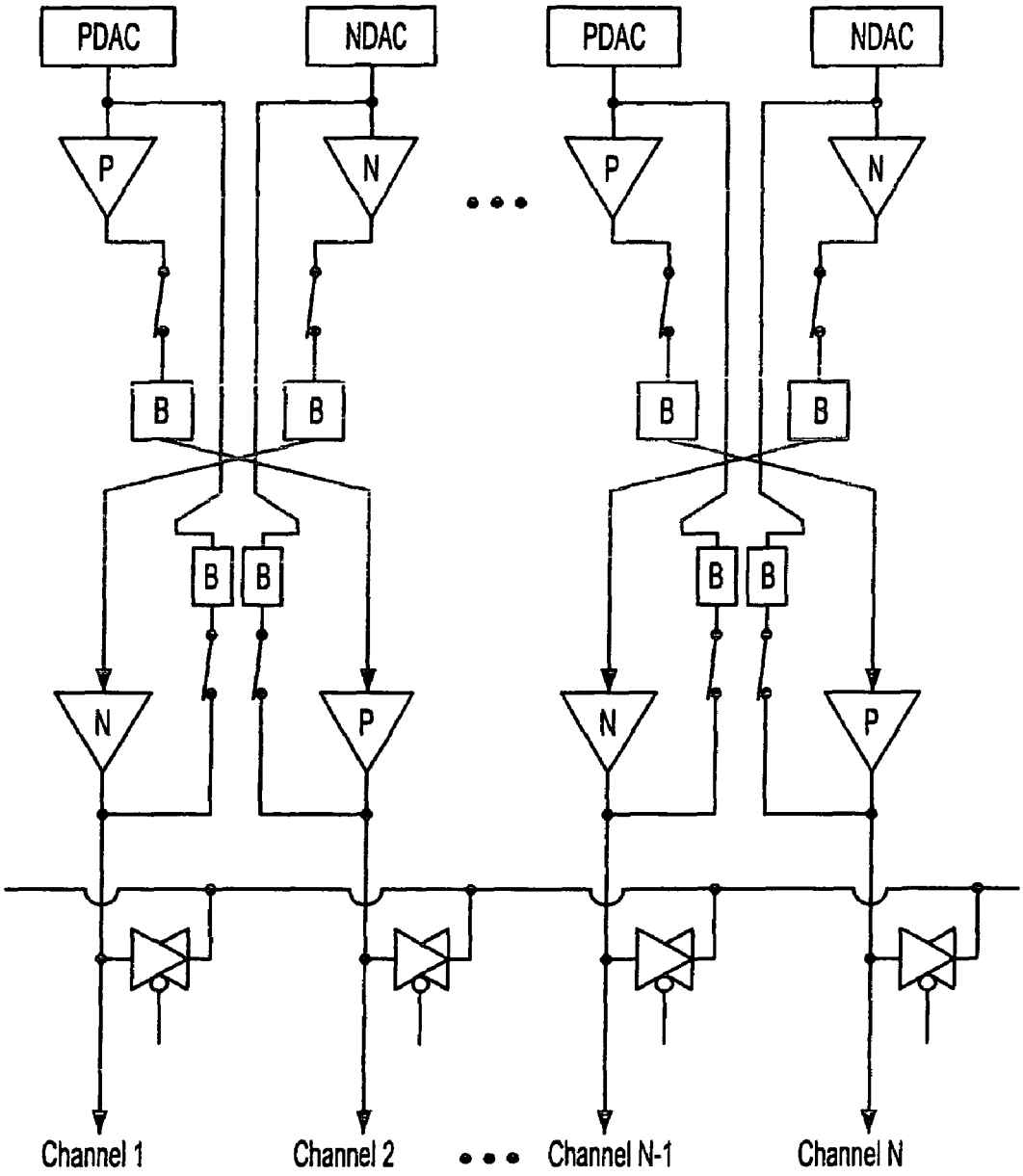

FIGS. 7A and 7B are circuit diagrams illustrating operation of the driving circuit of the flat panel display of FIG. 3.

Referring first to FIG. 7A, when all of the switches connected to nodes A of the switch unit 300 are turned on and the switches connected to nodes B are turned off, the driving circuit for driving the flat panel display drives the channels in the form of PNPNPN . . . . Referring to FIG. 7B, when all of the switches connected to nodes A of the switch unit 300 are turned off and the switches connected to nodes B are turned on, the driving circuit for driving the flat panel display drives the channels in form of NPNPNP . . . ._Therefore, the output drivers 410 and 420 of the output driving unit 400 alternately drive the negative and positive gamma values.

Figure 8:
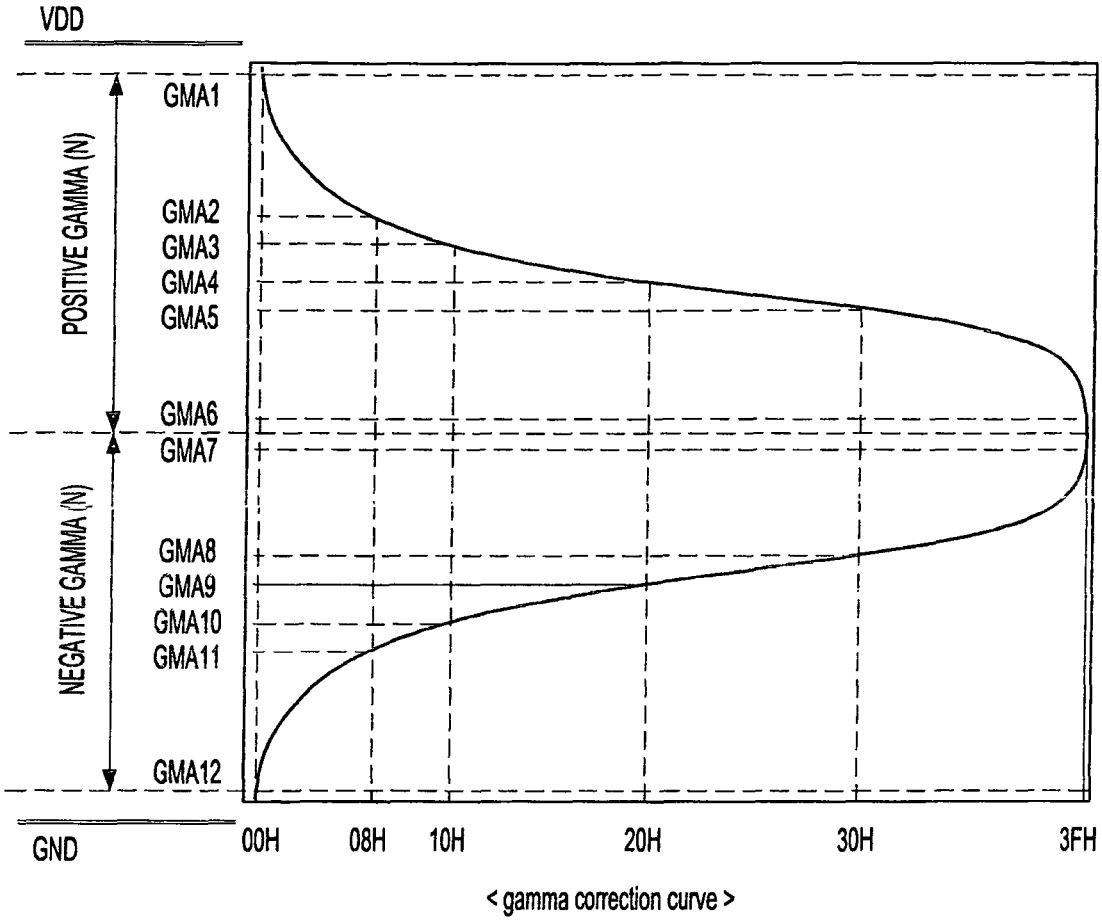
FIG. 8 is a waveform illustrating a gamma correction of the driving circuit of the flat panel display of FIG. 2.

FIG. 8 is a waveform illustrating a gamma correction of the driving circuit of the flat panel display of FIG. 2.

As shown in FIG. 8, the driving circuit of the flat panel display generates corrected gamma values by using signals having voltages of a Y-axis corresponding to digital values on an X-axis and drives the flat panel display. In FIG. 8, the positive gamma values and the negative gamma values are symmetrically illustrated.

As described above, the driving circuit of the flat panel display is configured to amplify the signal corresponding to the display information displayed on the flat panel display, transfer the signal to the output driver through switching operation, and improve the driving capability of the signal using the output driver. Therefore, the problem of the prior art where the signal that is improved in the driving capability is attenuated due to the switch resistance of the switch unit in the course of passing through the switch unit can be prevented. Therefore, there is no need for unnecessarily improving the driving capability of the output driver. Furthermore, since the signal passes through the switch unit before the signal is improved in the driving capability, thus the MOS transistor for the switch of the switch unit can be designed to be small. Additionally, the duration for transferring the signals from the data processing circuits PDAC and NDAC to the display panel via the output drivers can be significantly reduced.

According to the embodiments, the driving time and circuit area of the driving circuit of the flat panel display can be reduced. Additionally, since the driving capability is improved by using the signals passing through the switch unit, the signals passing through the switch unit are small and thus the MOS transistors of the switch unit can be designed to be small. Since the signals whose driving capability is improved by the output drivers are directly transferred to the channels without passing through the switches, the signals are not affected by the resistance components of the switch unit of the prior art, thus the signals are not attenuated. Therefore, the driving circuit of the flat panel display can drive the channels at high speed.

While the present invention has been described with respect to the specific embodiments, it will be apparent to those skilled in the art that various changes and modifications may be made without departing from the spirit and scope of the invention as defined in the following claims.

What is claimed is:

1. A driving circuit of a flat panel display, comprising:

a first data signal processing unit for converting a first display information that will be displayed on the flat panel display into a positive gamma value;

a second data signal processing unit for converting a second display information that will be displayed on the flat panel display into a negative gamma value;

a first signal amplifying unit for amplifying the positive gamma value from the first data signal processing unit to output the amplified positive gamma value to a switch unit; and a second signal amplifying unit for amplifying the negative gamma value from the second data signal processing unit to output the amplified negative gamma value to the switch unit; wherein the switch unit for selectively transferring the amplified positive and negative gamma values to an output driving unit;

the output driving unit for outputting the amplified negative and positive gamma values to the flat panel display;

the output driving unit enhances driving capability of a signal passing through the switching unit and transmits the signal directly to a flat display;

the switch unit comprises a feedback switch unit for feedback of an output of the output driver unit as an input of one of the first signal amplifying unit and the second signal amplifying unit;

the first data signal processing unit and the second data signal processing unit control two channels of the flat panel display;

the output driving unit includes:

a first output driver for receiving one of the amplified positive and negative gamma values from the switch unit to output a driving signal corresponding to a first channel; and a second output driver for receiving the other one of the amplified positive and negative gamma values from the switch unit to output a driving signal corresponding to a second channel; and the switch unit includes:

a first switch for transferring an output of the first signal amplifying unit to the first output driver;

a second switch for transferring the output of the first signal amplifying unit to the second output driver;

a third switch for transferring an output of the second signal amplifying unit to the first output driver;

a fourth switch for transferring the output of the second signal amplifier to the second output driver;

a fifth switch for feedback of an output of the first output driver as an input of the first signal amplifying unit;

a sixth switch for feedback of the output of the first output driver as an input of the second signal amplifying unit;

a seventh switch for feedback of an output of the second output driver as an the input of the first signal amplifying unit; and an eighth switch for feedback of the output of the second output driver as the input of the second signal amplifying unit.

2. The driving circuit as recited in claim 1, wherein each of the first and second signal amplifying units includes a differential amplifier for amplifying the signals that are differentially input.

3. The driving circuit as recited in claim 1, wherein the first signal amplifying unit includes a differential amplifier configured by one of PMOS transistors and NMOS transistors.

4. The driving circuit as recited in claim 1, wherein the first signal amplifying unit includes:

a differential amplifier for outputting a first positive gamma value that can charge electric charges in a channel corresponding to the first display information by receiving an output of the first and second output drivers and an input signal corresponding to the first display information; and a signal output unit for outputting a second positive gamma value that can discharge the electric charges to the channel in response to an output of the differential amplifier.

5. The driving circuit as recited in claim 1, wherein the second signal amplifying unit includes:

a differential amplifier for outputting a first negative gamma value that can charge the electric charges in a channel corresponding to the second display information by receiving the output of the first and second output drivers and an input signal corresponding to the second display information; and a signal output buffer for outputting a second negative gamma value that can discharge the electric charges to the channel in response to the output of the differential amplifier.

6. A method for driving a flat panel display, the method comprising:

converting a first display information to be displayed on the flat panel display into a positive gamma value by a first data signal processing unit;

converting a second display information to be displayed on the flat panel display into a negative gamma value by a second data signal processing unit;

amplifying the positive gamma value and outputting the amplified positive gamma value by a first signal amplifying unit;

amplifying the negative gamma value and outputting the amplified negative gamma value by a second signal amplifying unit;

transferring one of the amplified positive and negative gamma values through switching operation of a switch unit to an output driving unit; and driving the transferred amplified gamma value to a corresponding channel of the flat panel display, wherein driving capability is enhanced by transmitting the transferred amplified gamma value directly to the flat panel display, the switch unit comprises a feedback switch unit for feedback of an output of the output driver unit as an input of one of the first signal amplifying unit and the second signal amplifying unit, the first data signal processing unit and the second data signal processing unit control two channels of the flat panel display the output driving unit includes:

a first output driver for receiving one of the amplified positive and negative gamma values from the switch unit to output a driving signal corresponding to a first channel; and a second output driver for receiving the other one of the amplified positive and negative gamma values from the switch unit to output a driving signal corresponding to a second channel; and the switch unit includes:

a first switch for transferring an output of the first signal amplifying unit to the first output driver;

a second switch for transferring the output of the first signal amplifying unit to the second output driver;

a third switch for transferring an output of the second signal amplifying unit to the first output driver;

a fourth switch for transferring the output of the second signal amplifier to the second output driver;

a fifth switch for feedback of an output of the first output driver as an input of the first signal amplifying unit;

a sixth switch for feedback of the output of the first output driver as an input of the second signal amplifying unit;

a seventh switch for feedback of an output of the second output driver as an the input of the first signal amplifying unit; and an eighth switch for feedback of the output of the second output driver as the input of the second signal amplifying unit.

7. The method as recited in claim 6, further comprising, prior to performing the switching operation, amplifying the positive and negative gamma values.

* * * * *